US005239875A

United States Patent [19]

Stasiek et al.

[11] Patent Number: 5,239,875

[45] Date of Patent: Aug. 31, 1993

[54] TORQUE LIMITING TOOL

[75] Inventors: Jan S. Stasiek, Roswell; Steve A. Booher, Woodstock, both of Ga.

[73] Assignee: JS Technology, Inc., Alpharetta, Ga.

[21] Appl. No.: 838,019

[22] Filed: Feb. 20, 1992

[51] Int. Cl.[5] ..... B25B 23/14

[52] U.S. Cl. ..... 73/862.23; 73/862.21; 81/474

[58] Field of Search ..... 81/474, 483; 73/862.23, 73/862.195, 862.21, 862.22

[56] References Cited

U.S. PATENT DOCUMENTS

| | | | |
|---|---|---|---|
| 2,734,412 | 2/1956 | Orner | 81/474 |
| 2,897,932 | 8/1959 | Morgan . | |
| 2,984,133 | 5/1961 | Livermont . | |
| 3,001,430 | 9/1961 | Cranford | 81/474 |
| 3,069,191 | 12/1962 | DePew . | |
| 3,080,900 | 3/1963 | Rosenberg . | |
| 3,099,177 | 7/1963 | Kostka . | |
| 3,119,247 | 1/1961 | Grabovac . | |
| 3,270,594 | 9/1966 | Grabovac . | |
| 3,613,751 | 10/1971 | Juhasz | 81/474 |
| 3,890,859 | 6/1975 | Grabovac . | |
| 4,063,474 | 12/1977 | Klopping | 81/474 |
| 4,223,555 | 9/1980 | Alexander | 73/862.31 |

*Primary Examiner*—Richard E. Chilcot, Jr.
*Assistant Examiner*—R. Biegel
*Attorney, Agent, or Firm*—Jones & Askew

[57] ABSTRACT

A torque-limiting tool which comprises a drive member and a driven member. A plurality of balls extends from one of the members; a corresponding plurality of cylinders extends from the other. The relationship of the drive member and the driven member is such that when a torque is applied to the drive member, the balls and the cylinders engage and drive the driven member until a predetermined torque is applied. Once this torque is attained, the balls and cylinders mutually rotate so as to release the driven member. A calibration screw adjusts the overlap between the balls and cylinders to calibrate the limiting torque.

33 Claims, 3 Drawing Sheets

+3
17
16
15
12
70
71
89
92
91
92
86
66
87
10
13
85
86
86
14
86
+3

12
55
25
54
30
36
49
46
42
45
40
41
75

12
55
25
54
30
36
49
46
45
42
40
41
75

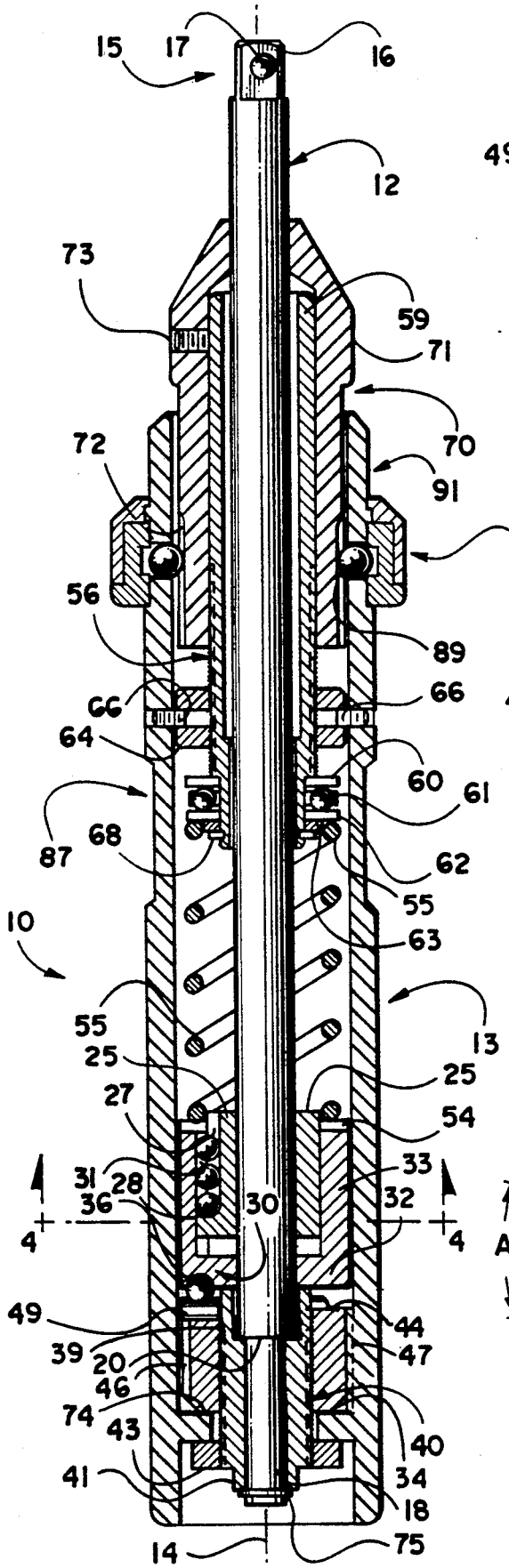
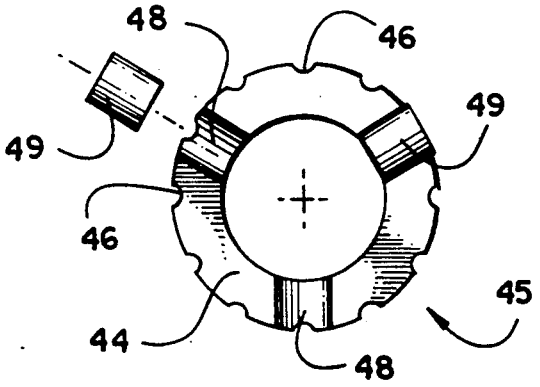
Fig. 6
Fig. 3
Fig. 4
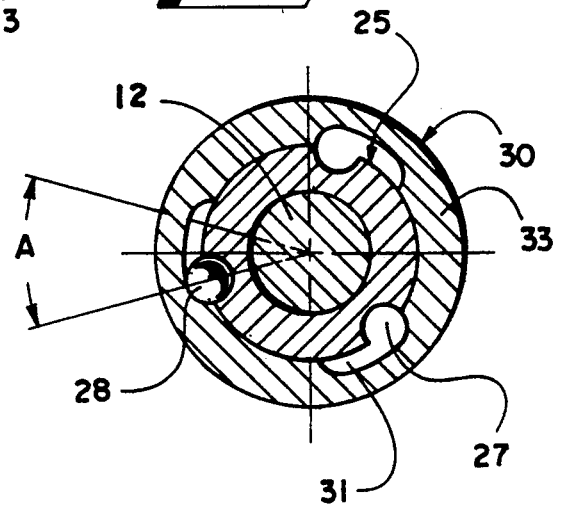

TORQUE LIMITING TOOL

TECHNICAL FIELD

The present invention relates to a torque transmission device, and relates more particularly to a torque-limiting tool which limits the applied torque to a predetermined maximum and is adjustable to vary the maximum.

BACKGROUND OF THE INVENTION

Current production needs force operations managers to assemble products in a short amount of time. However, intricate designs of products with close production tolerances are difficult to produce in such a hurried assembly. On many assemblies, a designated torque on a fastener may not be exceeded. However, if an assembly line worker is forced to use a standard torque wrench, he may have problems reading a gauge all day, especially in a hurried atmosphere. In addition, some applications may not allow the room needed for the broad, sweeping motion of a torque wrench.

In answer to this, torque-limiting tools have been introduced. These tools tighten a fastener to a given torque and then spin freely when a predetermined torque is reached. In low torque situations, a torque-limiting screwdriver may be used; that is, a tool which has a longitudinal axis that is common to the handle or driving element and the drive shaft or driven unit.

However, a problem exists in the screwdriver-type of torque tool in that torque cannot be measured as accurately as in a torque wrench because the moment arm of a screwdriver is so small. This is necessary because of design; the confined space of the screwdriver does not allow a large moment arm for measurement. In a wrench, deformation may be measured at a point one inch or more from the longitudinal axis of the fastener; in a screwdriver, the measurement must be made within about one-half inch or less. Since torque is a measurement of force times distance, the small moment arm makes the force at a given torque in the screwdriver-type tool much greater than in the wrench. Thus, small variations or deformations of measurement parts may cause large discrepancies in torque measurement. Also, large amounts of wear may occur to the parts because of the large amount of force applied. Therefore, in a torque-limiting tool, the main object is to produce a nearly frictionless slipping movement with a measuring device that will not vary in the force at which the slipping movement occurs because of wear or production imperfections. Recent low product tolerances on assembly lines demand a margin of error of four percent or less for this type of tool.

Attempts have been made to reduce wear and friction in order to produce a torque-limiting tool with a small margin of error. Examples of these types of tools are found in U.S. Pat. Nos. 2,984,133, 3,119,247, and 3,890,859. However, because of the problems discussed below, these tools do not provide a small enough margin of error.

In all of these prior devices, the torque-limiting tool comprises a drive shaft, which is the driven element, and a handle, the cylindrical driving element. The key to the torque limitation is the association between the driving element and the driven element. Generally, each element is associated with a plate which is generally perpendicular to the longitudinal axis of the tool. The two plates face each other and engage or disengage one another according to the amount of friction between the plates and the torque applied to the driving member. Thus, the two plates act much like the operation of a clutch mechanism. A spring forces the two plates together. In order to get the two plates to spin relative to one another, a torque must be applied to the driving element that overcomes the force of the spring and the friction of the plates. The geometrical configuration of the two plates determines the amount of friction and wear and therefore the accuracy of the clutch mechanism.

U.S. Pat. No. 2,984,133 teaches the use of a pair of dimple plates with balls interposed therebetween. When torque is applied to the dimple plate associated with the driving element, a moment arm is created across the ball. This causes the ball to apply a large amount of pressure on the edges of the dimple where the ball meets the surface of the plate, which creates a high wear area. Once this area is worn, duplication of engagement of the two plates is hard if not impossible to keep. In addition, the balls may roll out of the pocket.

U.S. Pat. No. 3,890,859 teaches a clutching assembly using balls and cylinders in conjunction with a ball driving bar. The cylinders are halfway inset into the first plate. These cylinders cross each other at the longitudinal axis of the torque-limiting tool and therefore are not rotatable. The opposing plate has a ball-engaging drive bar and balls that are interposed between the cylinders and the drive bar. When a proper amount of torque is applied, the drive bar forces the balls to engage the cylinders and eventually "roll" over them. Friction between the ball and the drive bar, and friction between the ball and the first plate cause inaccurate measurements in this torque-limiting tool. In addition, the cylinders, because they are not rotatable, have a constant point of contact which wears quickly. Thus, the instrument loses calibration after a number of cycles.

U.S. Pat. No. 3,119,247 also uses balls and cylinders in its clutching mechanism. However, in this invention, the balls are seated between a longitudinal guideway in the cylindrical driving member and concave seats in a plate positioned perpendicular to the longitudinal axis of the driving member. The seats force the balls up against the groove. The balls are allowed free movement longitudinally but not radially in the driving member. A spring pushes the balls toward a cylinder which passes through and is perpendicular to the driven unit. The cylinder may or may not be free to rotate. This invention still presents problems, however. The balls encounter friction at the guideway, the concave seats of the plate, and on the surface of the cylinder. Although the cylinder is free to rotate, it encounters two balls at once which work in opposite directions of rotation on the cylinder, preventing rotation of the cylinder. Thus, the movement of the balls in the guideway and the inability of the cylinder to rotate in response to force applied from the balls causes the device to have an excessive margin of error.

Thus, there is a need to restrict friction between the movable parts of the clutching mechanism of torque-limiting tools. This necessity dictates limiting points of contact between the opposing friction members to a minimum. However, these few fixed coordinates of contact need to be defined by varying surface locations on the engaging metal parts in order to reduce wear and therefore increase accuracy of calibration.

SUMMARY OF THE INVENTION

The present invention provides a torque-limiting tool comprising a driven member defining a longitudinal axis therethrough, a drive member mounted for rotation about the longitudinal axis, a plurality of balls each positioned in a corresponding ball seat defined in one of the members, each of the balls extending axially out of its respective ball seat, and a plurality of cylinders each positioned in a corresponding cylinder seat defined in the other of the members, each of the cylinders extending axially out of its respective cylinder seat. The members are positioned such that upon rotation of the drive member, the cylinders engage the balls and the driven member is rotated by the drive member. The torque-limiting tool is equipped with a means for biasing a first of the members towards a second of the members, such that upon application of a predetermined torque to the driven member, the biased member moves away from the second member against the force of the biasing means and the engaged balls and cylinders each rotate within the respective seats, allowing the drive member to rotate with respect to the driven member. The balls and cylinders thus engage at points of contact, but their mutual rotation continuously changes the parts of the balls and the cylinders which define the points of contact, thereby minimizing wear.

The torque-limiting tool may be equipped with a calibrating means for varying the distance by which each pair of the engaged balls and cylinders axially overlap so as to vary the predetermined torque. It may also comprise a drive shaft positioned to share the longitudinal axis and mounted in assembly with the driven member such that the driven member is capable of sliding axially on the drive shaft.

The drive member of the present invention may comprise a handle for use by an operator. A spring may be used as the biasing means. The force of this spring may be varied so as to vary the predetermined torque.

Lubrication for the seats of the present invention is preferably provided by a Teflon coating, and this Teflon coating may be the sole lubrication between the balls and the seat. This type of lubrication provides the least amount of friction and therefore the most accuracy in torque determinations.

The present invention further provides a torque transmission device which comprises a driven member defining a longitudinal axis therethrough, a plurality of balls each positioned in a corresponding ball seat and partially projecting from the driven member, a drive member mounted for rotation about the longitudinal axis, and a plurality of cylinders each positioned in a corresponding cylinder seat and partially projecting from the drive member. The drive member and the driven member are positioned adjacent to one another such that when a torque is applied to the drive member, the balls and the cylinders engage and drive the driven member until a predetermined torque has been obtained. Once this predetermined torque has been obtained, the balls and the cylinders mutually rotate so as to release the driven member. This embodiment can also include the benefits of the torque-limiting tool.

Thus, it is an object of the present invention to provide an improved torque-limiting tool.

It is a further object of the present invention to provide an improved torque transmission device.

Another object of the present invention is to provide a minimal amount of friction in a torque-limiting tool.

Yet another object of the present invention is to produce a nearly frictionless action in a torque-limiting tool with a torque transmission mechanism that will operate for a large number of cycles without variation because of wear or production imperfections.

It is an associated object of the present invention to limit the points of contact between the opposing friction members in the measuring device of a torque-limiting tool.

Other objects, features and advantages of the present invention will become apparent upon consideration of the following detailed description of the invention when taken in conjunction with the drawing and the appended claims.

BRIEF DESCRIPTION OF THE DRAWINGS

FIG. 3 is a longitudinal cross-sectional view of the same embodiment, taken along line 3—3 of FIG. 1.

FIG. 4 is a transverse cross-sectional view along the line 4—4 of FIG. 3, showing the association of the stator with the drive member of the present invention.

FIG. 6 is a top elevation showing the drive member for the torque limiting tool of FIG. 1.

DETAILED DESCRIPTION OF THE PREFERRED EMBODIMENT

Figures 1, 5A, 5B:
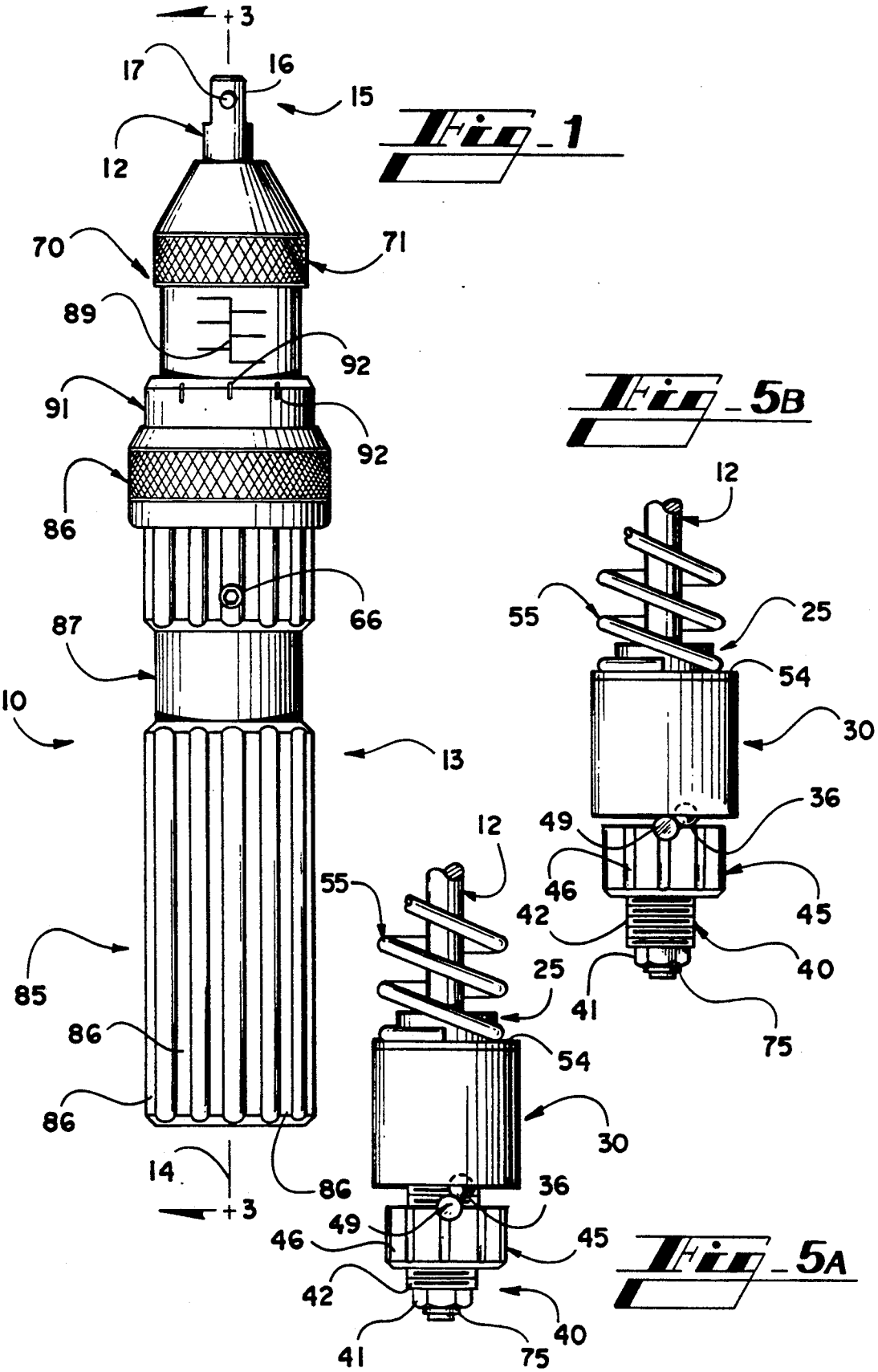
FIG. 1 is a side elevational view showing an embodiment of the torque-limiting tool of the present invention.
FIG. 5A is a side elevational view of the drive member and driven member for the torque-limiting tool of FIGS. 1 and 2 showing the overlap of the balls and cylinders adjusted for a low torque application.
FIG. 5B is a side elevation showing the drive member and driven member of FIG. 5A with the overlap of the balls and cylinders adjusted for a high torque application.
Figure 2:
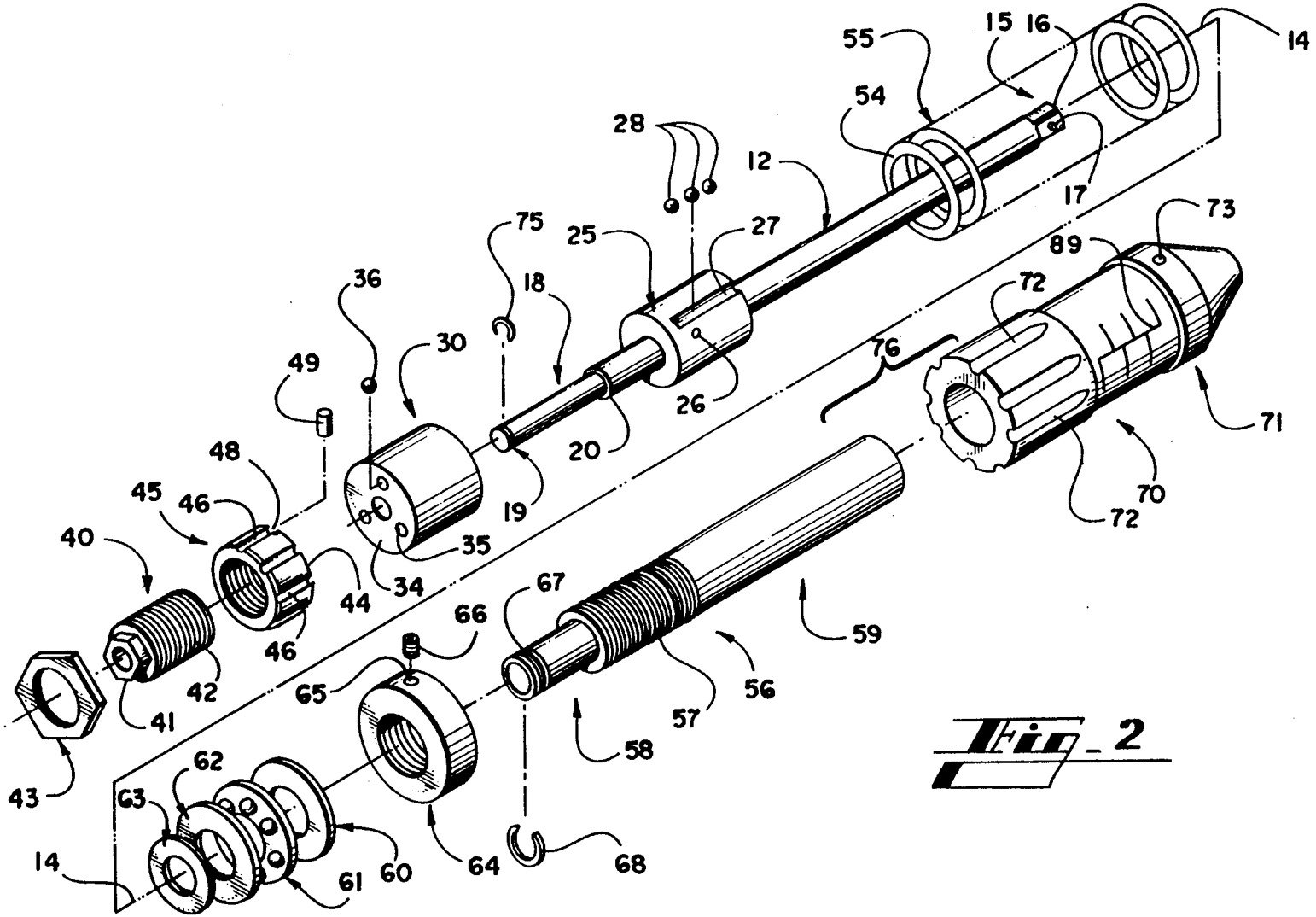
FIG. 2 is an exploded perspective view of the torque-limiting tool of FIG. 1.

Referring now in more detail to the drawing, in which like reference numerals refer to like parts throughout the several views, FIG. 1 shows the preferred embodiment of the torque-limiting tool 10 of the present invention. A drive shaft 12 carrying an internal assembly of working parts is substantially encased inside a tubular body or handle 13. The drive shaft 12 and the tubular body 13 share a common longitudinal axis 14. An exploded perspective view of the drive shaft 12 and internal assembly, separate from the tubular body 13 is shown in FIG. 2. The drive shaft 12 is generally circular in cross-section and comprises a work engaging head 15 at one end.

While the tool 10 can be used in any orientation, for ease of description, the end of the tool corresponding to the work-engaging head 15 will be referred to herein as the upper end of the tool 10 and the end opposite the work engaging head 15 will be referred to as the lower end of the tool 10. The upper portion of the internal assembly consists of a conventional adjustment mechanism for setting the limiting torque of the tool. The lower portion consists of a novel torque transmission mechanism.

In the construction shown, the work-engaging head 15 comprises a male drive piece 16, which has a spring-loaded detent 17 to lock on various sized sockets (not shown). If desired, the work-engaging head 15 of the drive shaft 12 may be equipped with a screwdriver blade instead of the male drive piece 16. The lower end of the drive shaft 12 or the end opposite the work-engaging head 15 contains a section 18 which is narrower in diameter than the rest of the drive shaft 12. At the lowermost part of the section 18 is an annular groove 19. At the other end of the section 18 is a calibration screw abutment 20 located at the point at which the shaft 12 enlarges to its full diameter.

Turning to the torque transmission mechanism, a stator 25 is firmly attached to the drive shaft 12 at a position just above the calibration screw abutment 20. As shown in FIG. 2, the stator 25 is substantially circular in cross-section and comprises a cylindrical hole centered and passing longitudinally therethrough for fitting over and around the drive shaft 12. The stator 25 is held firmly in place by a pin 26. An alternative embodiment of the present invention would cast the stator 25 and the drive shaft 12 as one piece. A plurality of longitudinal grooves 27 are located on the outer diameter of the stator 25 for cooperation with a corresponding plurality of axial movement balls 28. The grooves 27 are semicircular in cross-section, as best shown in FIG. 4. In the preferred embodiment of the invention, the longitudinal grooves 27 do not extend the length of the stator 25 but instead stop just short of the lower end. The cross section of the longitudinal groove is rounded to the radius of the balls 28 to prevent excessive movement of the balls 28. The grooves 27 are preferably a depth of about one half of the diameter of the balls 28. In this embodiment of the invention, there are three equally spaced longitudinal grooves 27 and nine corresponding axial movement balls 28. Three balls 28 fit into each groove 27.

A cup-shaped driven member 30 is slidingly mounted on the drive shaft 12 and the stator 25 and is formed with a plurality of internal longitudinal grooves 31 to receive the axial movement balls 28. As shown in FIG. 4, the member 30 keeps the balls in rolling engagement with the longitudinal grooves 27 on the stator 25. The driven member 30 comprises an annular plate 32 at one end. The inner diameter of the annular plate 32 corresponds to the diameter of the drive shaft 12. From the outer radius of the annular plate 32 extends a tubular sleeve 33 in which is formed the internal longitudinal grooves 31. As indicated in FIG. 3, the annular plate 32 fits over the drive shaft 12 just below the stator 25 with the tubular sleeve 33 substantially encasing the stator 25 and open toward the upper end of the drive shaft 12. In the preferred embodiment, the internal longitudinal grooves 31 are a depth of approximately one half of the diameter of the balls 28. However, instead of having a semi-circular cross-section, the grooves 31 are extended arcuately to give some "play" to the mounting of the driven member 30. The outer edges of the grooves 31 are rounded to the radius of the balls 28 to provide substantial bearing contact with the balls 28. In the construction shown, the grooves 31 extend through a 30° arc around the interior of the tubular sleeve 33, the arc being measured from the center of one upper radius to the center of the other upper radius as indicated by the arc A in FIG. 4.

The lower side of the annular plate 32 comprises a flat surface 34, the plane of which is perpendicular to the longitudinal axis 14. Inset in the flat surface is a plurality of ball seats 35, best seen in FIG. 2. The ball seats 35 are preferably hemispheres and are spaced at points which are radially equidistant from the longitudinal axis 14 and arcuately equidistant from one another. These ball seats 35 receive a corresponding plurality of mating torque-transmitting balls 36. In this embodiment of the invention the seats 35 and balls 36 share substantially the same radius and the number of the ball seats 35 and torque-transmitting balls 36 is three. The seats 35 are preferably coated with polytetraflouroethylene (Teflon) to minimize friction between the balls 36 and the seats 35.

A calibration screw 40 with a cylindrical hole extending the length thereof is mounted for rotation about the sleeve section 18 of the drive shaft 12 and abuts the calibration screw abutment 20. In the construction shown, the calibration screw 40 defines a recess 39 which receives and engages the calibration screw abutment 20 and causes the calibration screw 40 to axially overlap the larger diameter portion of the drive shaft 12, as shown in FIG. 3. The calibration screw 40 is preferably cast with a hex head nut 41 at the lower end and threads 41 extending the rest of the cylindrical length. A lock nut 43 is threaded onto the threads 41 and is used to hold the internal assembly of working parts in the tubular body 13 and to lock the assembly at the proper calibration. The relationship of this lock nut 43 to the tubular body 13 is explained in detail below.

The calibration screw 40 is threaded through a drive member 45 such that the rotation of the calibration screw 40 relative to the drive member 45 causes the drive member to move axially along the drive shaft 12. A plurality of peripheral, longitudinal grooves 46 are located on the drive member 45 for cooperation with a corresponding plurality of longitudinal knurls 47 located on the interior of the tubular body 13. At the upper end 44 of the drive member 45 are located a plurality of equally-spaced cylinder seats 48 as is best shown by FIG. 6. Preferably, the cylinder seats 48 are situated in the drive member 45 such that the longitudinal axis of the cylinder seats 48 extend radially from the longitudinal axis 14 of the drive shaft 12. These cylinder seats 48 cooperate with a corresponding plurality of cylinders 49 which rest in the seats 48 and extend axially out of the drive member 45. In the construction shown, the axes and radii of the cylinder seats 48 and the cylinders 49 are substantially the same and approximately one half of each cylinder 49 extends axially out of the drive member 45. The cylinder seats 48 are coated with Teflon so as to minimize the friction that normally occurs when the cylinders 49 are rotated.

As can be understood from the description thus far, the upper end 44 of the drive member 45 and the lower flat surface 34 of the driven member 30 are in facing relationship to one another. This relationship is best depicted in FIGS. 5A and 5B. Preferably, the number of torque-transmitting balls 36 and cylinders 49 is equal. In this embodiment, that number is three. In addition, it is also preferred that the balls 36 and the cylinders 49 extend axially out of their respective members the same amount. The relationship of the balls 36 and the cylinders 49 is such that rotation of the drive member 45 relative the driven member 30 causes all of the balls 36 to engage corresponding cylinders 49 at the same time at a certain point in the rotation. This point is depicted in FIGS. 5A and 5B. The amount the balls 36 and the cylinders 49 axially overlap may be varied by rotating the calibration screw 40 relative to the drive member 45 to change the axial position of the calibration screw 40. The drive member 45 is threaded far enough on the calibration screw 40 so that the calibration screw 40 abuts or almost abuts the flat surface 34 of the driven member 30. If the calibration screw 40 is not abutting the driven member 30, then the cylinders 45 come in contact with the flat surface 34 of the driven member 30 and the torque-transmitting balls 36 come into contact with the upper end 44 of the drive member 45 as shown in FIG. 5B. Rotation of the calibration screw 40 into the drive member causes the calibration screw 40 to abut the driven member 30 and moves the balls 36 away from the upper end 44 of the drive member 45 and the cylinders 49 away from the flat surface 34 of the driven member 30. Further rotation varies the amount of overlap between the balls 36 and the cylinders 49.

At the upper end of the internal assembly is located a conventional adjustment mechanism for setting the desired torque to be used in operation of the tool 10. Torque is set mainly by varying the amount a relatively heavy coil spring 55 is compressed. The spring 55 surrounds the upper end of the stator 25 to exert pressure against the driven member 30 and to urge the driven member 30 towards the drive member 45. A washer 54 is interposed between the spring 55 and the driven member 30. The other end of the spring 55 surrounds one end of an adjustment screw 56. In this embodiment of the invention, the adjustment screw 56 is generally circular in cross-section and is mounted for axial movement on the drive shaft 12. A rod-like extension 58 which is narrower in cross-section than the rest of the adjustment screw 56 extends from the lower end of the screw 56 into the spring 55. Threads 57 are cut into the screw 56 from the extension 58 to about the midpoint of the adjustment screw 56. The rest of the adjustment screw 56 consists of a shank 59 with a smooth surface.

Preferably, an anti-friction thrust bearing 61 is interposed between the spring 55 and the adjustment screw 56. In the construction shown in FIGS. 2 and 3, a washer 60 is fitted over the extension 58 and abuts the threaded portion 57. The annular thrust bearing 61 is of a ball bearing type and is interposed between this washer 60 and a second washer 62. The spring 55 abuts this second washer 62. A suitable annular bushing 63 fits over the extension 58 and is seated in the upper end of the spring 55 to prevent radial movement of the spring 55. A C-shaped retainer 68 holds the bushing 63, the washer 60, the thrust bearing 61 and the second washer 62 on the extension 58. A round nut 64 is threaded onto the threads 57 of the screw 56. Preferably, the round nut 64 includes a plurality of radial threaded holes 65 for receiving corresponding set screws 66. The relation of the set screws 66 with the tubular body 13 is explained in detail below.

Fixedly mounted on the shank 59 of the adjustment screw 56 for rotation therewith is an adjustment sleeve 70 which is formed with a knurled flange 71 for manual operation. This knurled flange 71 may be rotated relative the tubular body 13 to set a desired torque for the tool 10, as is explained in detail below. A plurality of longitudinal grooves 72 are formed in the surface of the adjustment sleeve 70. The grooves 72 provide a camming action in association with the tubular body 13 as explained below to lock or unlock the torque adjustment mechanism. Preferably, the adjustment sleeve 70 is secured on the adjustment screw 56 by a suitable set screw 73. The adjustment sleeve 70 and the adjustment screw 56 form an adjustment assembly 76 and may, if desired, be cast in one piece.

The entire internal mechanism thus far described is journalled in a suitable fashion inside the tubular body 13. An annular flange 74, shown in FIG. 3, extends radially inwardly from the tubular wall of the tubular body 13 near its lower end. The calibration screw 40 extends past the flange 74. To hold the calibration screw 40 and drive member 45 in place, the locking nut 43 is threaded onto the screw 40 until it engages the flange 74. The drive member 45 fits snugly into the tubular body 13 through the internal knurls 47 and abuts the flange 74. A C-shaped retainer 75 fits into the annular groove 19 to prevent the drive shaft 12 from sliding out of the calibration screw 40 and holds the calibration screw 40 against the abutment 20 on the drive shaft 12. The grooves 46 of the drive member 45 fit onto the internal knurls 47 of the tubular body 13 to prevent rotation of the drive member 45 relative the tubular body 13. In order to keep the adjustment assembly 76 in place in the tubular body 13, the round nut 64 is journalled to fit snugly in the interior of the tubular body 13 and is held in a fixed position within the tubular body 13 by the set screws 66. However, the screw 56 can be moved axially through the nut 64 by rotating the sleeve 70.

The outside of the tubular body 13 is also cylindrical in shape and preferably provides a handle 85. In the construction shown, the handle 85 defines a plurality of flutes 86 to provide a secure grip when grasped by the hand of an operator. If desired, the handle 85 can include a flat, recessed area 87 for stamping on a brand name (not shown) or the like. Near the uppermost end of the tubular body 13 is a conventional locking mechanism. The locking mechanism comprises a knurled sleeve 88 fitted over the tubular body 13. An upper end 91 of the tubular body extends above the sleeve 88. The sleeve 88 is manually operated to lock the adjustment sleeve 70 in place in the tubular body 13. As will be known to those skilled in the art, this mechanism 88 contains a plurality of cam surfaces (not shown) which cooperate with a corresponding plurality of balls 89 which extend through openings in the body 13. Rotation of the mechanism 88 in one direction about the tubular body 13 causes the balls 89 to be pressed radially inwardly. These balls are directed by the cams into the grooves 72 in the adjustment sleeve 70 and prevent rotation of the adjustment assembly 76. Rotation of the locking mechanism 88 in the other direction causes the balls 89 to retract into the tubular body 13 enough so that the adjustment assembly 76 may be turned past the balls 89.

Operation of the adjustment assembly 76 is such that rotation of the adjustment sleeve 70 relative the tubular body 13 causes the adjustment screw 56 to move axially with respect to the tubular body 13. Movement of the adjustment screw 56 downwardly causes the spring 55 to compress and thus causes more pressure to be applied to the drive member 45 by means of the driven member 30. Therefore, more torque is required to rotate the cylinders 49 of the drive member 45 over the balls 36 of the driven member 30. A suitable scale 90 is provided on the adjustment sleeve 70 for indicating the amount of insertion of the adjustment screw 56. Preferably, marks on the scale 90 correspond to a complete rotation of the adjustment assembly 76 relative the tubular body 13 and are in designations of torque values for the torque-limiting tool 10 of the present invention. A second scale 92 is located circumferentially about the upper end 91 of the tubular body 13 for indicating more precise measurements in a known manner. The marks on the scale 92 correspond to the "clicks" that occur when the adjustment assembly 76 is rotated. Preferably, the number of grooves 72 about the adjustment sleeve 70 are in even increments of the numeric marks on the adjustment sleeve scale 90. For example, if the scale 90 is in increments of 6 foot-pounds (6, 12, 18, etc.), the number of grooves 72 could be 6 or 12. Thus, the marks on the circumferential scale 92 may occur at every groove or at every other groove and indicate smaller units between the marks on the larger scale 90.

The manner in which the invention functions for its purpose may be readily understood from the foregoing description. It is apparent that when the torque load is less than the torque setting of the tool, rotation of the tubular body 13 causes the cylinders 49 of the drive member 45 to engage the torque transmission balls 36 and turn the drive member 30 along with the tubular body 13. Since the balls 36 extend into the plane of the axially extended cylinders 49, all of the cylinders 49 engage a respective ball 36 to cause the driven member 30 and the shaft 12 to rotate with the drive member 45. Thus, the whole tool functions as a single unit. On the other hand, if the torque load or resistance to rotation of the driven member 30 exceeds the torque setting of the tool, the driven member 30 slides away from the drive member 45 against the force of the spring 55, and the balls 36 and the cylinders 49 mutually rotate within their respective seats. This allows the drive member 45 to rotate with respect to the driven member 30. The amount of torque needed to cause the drive member 45 to slip with respect to the driven member 30 is determined by two factors: first, the amount of overlap between the balls 36 and the axially extended cylinders 49; and second, the amount of force applied by the spring 55 through the driven member 30 to the drive member 45. The amount of overlap between the balls 36 and the cylinders 49 is set by the calibration screw 40; the amount of force applied by the spring 55 is set mainly by the adjustment assembly 76. Proper adjustment of the calibration of the tool 10 is obtained by proper positioning of the calibration screw 40 for respective torques and torque readings on the adjustment sleeve 70 scale 90.

In the calibration procedure of the tool 10, the adjustment assembly 76 is set to the highest torque value on the scale 90 and a standardized torque matching this setting is applied to the work engaging head 15. If the cylinders 49 in the drive member 45 do not "roll over" the balls 36 in the driven member 30, the calibration screw is adjusted to change the overlap of the cylinders 49 and the balls 36, and the process is repeated until the setting matches the standardized torque. The calibration screw 40 may be turned relative to the drive member 45 by use of the hex head 41 at the end of the calibration screw 40. Preferably, the tool 10 is assembled so that the calibration procedure begins with the balls 36 pressed against the drive member 45 and the cylinders 49 pressed against the driven member 30. The calibration screw 40 is then turned inward until it abuts the driven member 30. Another one quarter to one half a turn pushes the driven member 30 away from the cylinders 49 and the drive member 45 away from the balls 36. This positioning provides the least amount of friction and wear for the balls 36 and cylinders 49. In addition, the close positioning of the drive member 45 to the driven member 30 prevents the balls 36 and the cylinders 49 from falling out of their respective seats.

The clutching mechanism provided by the balls 36 in the driven member 30 and the cylinders 49 in the drive member 45 provides an improved, low-wear and low-friction torque transmission device. The ability of the balls 36 and the cylinders 49 to engage and mutually rotate with a minimum amount of friction provides a torque-limiting device with a minimum margin of error. In addition, the ability of the balls 36 and the cylinders 49 to rotate ensures that the parts of the balls 36 and the cylinders 49 which define the points of contact continually change. This feature minimizes the wear on these parts and allows the maximum number of cycles within this small margin of error.

While this invention has been described in detail with particular reference to preferred embodiments thereof, it will be understood that variations and modifications can be affected within the spirit and scope of the invention as described hereinbefore and as defined in the appended claims.

What is claimed is:

1. A torque-limiting tool for applying a force to a workpiece through a work engaging head, said tool comprising:

a driven member defining a longitudinal axis therethrough, said driven member being connected to a work engaging head such that said driven member rotates with said work engaging head;

a drive member for driving said driven member and mounted for rotation about said longitudinal axis;

a plurality of balls each positioned in a corresponding ball seat defined in one of said members, each of said balls extending axially out of its respective ball seat;

a plurality of discrete cylinders each positioned in a corresponding cylinder seat comprising a recess in a surface of the other of said members, each of said cylinders extending axially out of its respective cylinder seat;

said members being positioned such that upon rotation of said drive member, said cylinders engage said balls and said driven member is rotated by said drive member; and means for biasing a first of said members toward a second of said members, such that upon application of a predetermined torque to said driven member, said first member moves away from said second member against the force of said biasing means and said engaged balls and cylinders each rotate within their respective seats, allowing said drive member to rotate with respect to said driven member.

2. The torque-limiting tool of claim 1, further comprising calibrating means for varying the distance by which each pair of said engaged balls and said cylinders axially overlap so as to vary said predetermined torque.

3. The torque-limiting tool of claim 2, further comprising a drive shaft connected to said work engaging head and positioned to share said longitudinal axis and mounted in assembly with said driven member such that said drive shaft rotates about said axis with said driven member and said driven member may slide axially on said drive shaft.

4. The torque-limiting tool of claim 3, wherein said calibrating means comprises a calibration screw mounted for rotation about said drive shaft and threaded into one of said members, such that rotation of said calibration screw into said member threaded onto said calibration screw causes said member to move axially on said drive shaft such that the distance by which each pair of said engaged balls and said cylinders axially overlap is varied.

5. The torque-limiting tool of claim 1, wherein said drive member is connected to a handle and rotates with said handle.

6. The torque-limiting tool of claim 1, wherein said means for biasing comprises a spring.

7. The torque-limiting tool of claim 6, further comprising means for varying the biasing force of said spring so as to vary said predetermined torque.

8. The torque-limiting tool of claim 1, wherein said balls are ballbearings.

9. The torque-limiting tool of claim 1, said ball seats for said balls further comprising a Teflon coating, wherein said Teflon coating is the sole lubrication between said balls and said balls seats.

10. The torque-limiting tool of claim 9, said cylinder seats for said cylinders further comprising a Teflon coating, wherein said Teflon coating is the sole lubrication between said cylinders and said cylinder seats.

11. The torque-limiting tool of claim 1, said cylinder seats for said cylinders further comprising a Teflon coating, wherein said Teflon coating is the sole lubrication between said cylinders and said cylinder seats.

12. The torque-limiting tool of claim 1, wherein the number of said balls is three and the number of said cylinders is three.

13. A torque-limiting tool comprising:

a drive shaft defining a longitudinal axis therethrough;

a driven member mounted to rotate with said drive shaft, said driven member capable of sliding axially on said drive shaft;

a plurality of balls each positioned in a corresponding ball seat defined in said driven member, each of said balls extending axially out of its respective ball seat;

a drive member for driving said driven member and mounted for rotation about said longitudinal axis of said drive shaft;

a plurality of discrete cylinders each positioned in a corresponding cylinder seat comprising a recess in a surface of said drive member, each of said cylinders extending axially out of its respective cylinder seat;

said drive member and said driven member being positioned such that upon rotation of said drive member around said longitudinal axis of said drive shaft, said cylinders engage said balls and said driven member is rotated by said drive member, and means for biasing said driven member toward said drive member such that upon application of a predetermined torque to said driven member, said driven member slides away from said drive member against the force of said biasing means and said balls and said cylinders rotate within their respective seats, allowing said drive member to rotate with respect to said driven member.

14. The torque-limiting tool of claim 13, further comprising a calibrating means for varying the distance by which each pair of said engaged balls and said cylinders axially overlap so as to vary said predetermined torque.

15. The torque-limiting tool of claim 14, wherein said calibrating means comprises a calibration screw mounted for rotation about said drive shaft and threaded into one of said members, such that rotation of said calibration screw into said member threaded onto said calibration screw causes said member to move axially on said drive shaft such that the distance by which each pair of said engaged balls and said cylinders axially overlap is varied.

16. The torque-limiting tool of claim 15, wherein said drive member is connected to a handle and rotates with said handle.

17. The torque-limiting tool of claim 16, wherein said drive member is capable of sliding axially inside said handle.

18. The torque-limiting tool of claim 13, wherein said drive member is connected to a handle and rotates with said handle.

19. The torque-limiting tool of claim 13, wherein said means for biasing comprises a spring.

20. The torque-limiting tool of claim 19, further comprising means for varying the biasing force of said spring so as to vary said predetermined torque.

21. The torque-limiting tool of claim 13, wherein said balls are ballbearings.

22. The torque-limiting tool of claim 13, said ball seats for said balls further comprising a Teflon coating, wherein said Teflon coating is the sole lubrication between said balls and said ball seats.

23. The torque-limiting tool of claim 22, said cylinder seats for said cylinders further comprising a Teflon coating, wherein said Teflon coating is the sole lubrication between said cylinders and said cylinder seats.

24. The torque-limiting tool of claim 13, said cylinder seats for said cylinders further comprising a Teflon coating, wherein said Teflon coating is the sole lubrication between said cylinders and said cylinder seats.

25. The torque-limiting tool of claim 13, wherein the number of said balls is three and the number of said cylinders is three.

26. A torque transmission device comprising:

a driven member defining a longitudinal axis therethrough;

a plurality of balls each positioned in a corresponding ball seat and partially projecting from said driven member;

a drive member for driving said driven member and mounted for rotation about said longitudinal axis;

a plurality of discrete cylinders each positioned in a corresponding cylinder seat comprising a recess in a surface of said drive member and partially projecting from said drive member, each of said cylinder seats extending axially out of its respective cylinder seat;

said members positioned adjacent to one another such that when a torque is applied to said drive member, said balls and said cylinders engage and drive said driven member and said balls and said cylinders mutually rotate so as to release said driven member once a predetermined torque has been attained.

27. The torque-limiting tool of claim 26, said ball seats for said balls further comprising a Teflon coating, wherein said Teflon coating is the sole lubrication between said cylinders and said ball seats.

28. The torque-limiting tool of claim 27, said cylinder seats further comprising a Teflon coating, wherein said Teflon coating is the sole lubrication between said cylinders and said cylinder seats.

29. The torque-limiting tool of claim 26, said cylinder seats further comprising a Teflon coating, wherein said Teflon coating is the sole lubrication between said cylinders and said cylinder seats.

30. The torque limiting tool of claim 1, wherein each of said ball seats has a radius which is substantially the same as the radius of the corresponding ball.

31. The torque limiting tool of claim 1, wherein each of said balls contacts a cylinder at a location on the cylinder which is diametrically opposite a contact point of the cylinder with the respective cylinder seat.

32. The torque limiting tool of claim 1, wherein each of said cylinder seats has a radius which is substantially the same as the radius of the corresponding cylinder.

33. The torque limiting tool of claim 1, wherein each of said balls engages a respective cylinder at approximately the midpoint of the length of said cylinder.

* * * * *